US010054114B2

(12) United States Patent
Kimura

(10) Patent No.: US 10,054,114 B2
(45) Date of Patent: Aug. 21, 2018

(54) CRYOPUMP AND METHOD OF MONITORING CRYOPUMP

(75) Inventor: Toshiyuki Kimura, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 1275 days.

(21) Appl. No.: 12/805,253

(22) Filed: Jul. 21, 2010

(65) Prior Publication Data

US 2011/0016890 A1 Jan. 27, 2011

(30) Foreign Application Priority Data

Jul. 22, 2009 (JP) ..... 2009-171285

(51) Int. Cl.

| | |
|---|---|
| ***F04B 37/08*** | (2006.01) |
| ***B01D 8/00*** | (2006.01) |
| ***F04D 27/00*** | (2006.01) |
| ***F04B 49/06*** | (2006.01) |

(52) U.S. Cl.

CPC ..... *F04B 37/08* (2013.01); *F04B 49/065* (2013.01); *F04B 2201/0801* (2013.01)

(58) Field of Classification Search

CPC ..... F04B 37/08–37/085; B01D 8/00; F04D 27/00

USPC ..... 62/55.5, 129, 157, 172, 268, 6, 56; 417/901

See application file for complete search history.

(56) References Cited

U.S. PATENT DOCUMENTS 4,604,871 A * 8/1986 Chiu ..... F25D 29/008 340/588
4,757,689 A * 7/1988 Bachler ..... F04B 37/08 417/901
4,958,499 A * 9/1990 Haefner ..... F04B 37/08 417/901

(Continued)

FOREIGN PATENT DOCUMENTS

JP 06-301617 A 10/1994
JP 07-293438 A 11/1995

(Continued)

OTHER PUBLICATIONS

Machine Translation of JP 06-301617, translated Apr. 2013.*

(Continued)

*Primary Examiner* — Grant Moubry
*Assistant Examiner* — Kirstin Oswald
(74) *Attorney, Agent, or Firm* — Michael Best & Friedrich LLP

(57) ABSTRACT

A cryopump pumps gas from a vacuum chamber in a vacuum apparatus performing vacuum processing. The cryopump comprises: a refrigerator; a cryopanel cooled by the refrigerator; and a controller configured to control an operating cycle of the refrigerator such that the cryopanel is controlled so as to have a target temperature. When an operating cycle of the refrigerator has reached a first determination reference, the controller monitors the operating cycle for a first determination period of time, and when the operating cycle has reached a second determination reference, which corresponds to a higher load than the first determination reference, the controller monitors a temperature of the cryopanel for a second determination period of time, which is shorter the first determination period of time.

6 Claims, 4 Drawing Sheets

(56) References Cited

U.S. PATENT DOCUMENTS 5,513,499 A * 5/1996 deRijke ..... F04B 37/085 415/90
5,582,017 A * 12/1996 Noji ..... F04B 37/08 417/901
5,819,545 A * 10/1998 Eacobacci, Jr. ..... F04B 37/085 62/55.5
5,855,118 A * 1/1999 Lorimer ..... F04B 37/02 417/901
6,022,195 A * 2/2000 Gaudet ..... F04B 37/08 417/27
7,249,465 B2 * 7/2007 Arman ..... F25B 9/145 62/6
7,415,831 B2 * 8/2008 Amundsen ..... F04B 37/08 62/55.5
2002/0104320 A1 * 8/2002 Gaudet ..... F04B 37/08 62/55.5
2002/0184896 A1 * 12/2002 Buonpane ..... F04B 37/08 62/55.5
2003/0024252 A1 * 2/2003 Funayama ..... B01D 8/00 62/55.5
2004/0261426 A1 * 12/2004 Amundsen ..... F04B 37/08 62/55.5
2006/0026968 A1 * 2/2006 Gao ..... 62/6
2006/0101836 A1 * 5/2006 Tanaka ..... F04B 37/08 62/228.1
2006/0225876 A1 * 10/2006 Shimizu ..... F25B 49/02 165/263
2006/0288710 A1 * 12/2006 Legall ..... F25B 9/14 62/6
2007/0068181 A1 * 3/2007 Kim ..... F25B 49/022 62/228.1
2009/0126374 A1 * 5/2009 Arai ..... F04B 37/08 62/55.5
2010/0186427 A1 7/2010 Okada et al.

FOREIGN PATENT DOCUMENTS

JP 2003-056926 A 2/2003
WO WO-2009/028450 A1 3/2009

OTHER PUBLICATIONS

Japanese Office Action dated Jan. 24, 2012 for corresponding Japanese Application No. 2009-171285.
Office Action issued in Japanese Patent Application No. 2011-156932, dated Feb. 19, 2013.

* cited by examiner

CRYOPUMP AND METHOD OF MONITORING CRYOPUMP

BACKGROUND OF THE INVENTION

1. Field of the Invention

The present invention relates to a cryopump and a method of monitoring the cryopump.

2. Description of the Related Art

A cryopump is a vacuum pump that captures and pumps gas molecules by condensing or adsorbing molecules on a cryopanel cooled to an extremely low temperature. A cryopump is generally used to achieve a clean vacuum environment required in a semiconductor circuit manufacturing process.

For example, Japanese Patent Application Publication No. H6-301617 describes a production management system in which a plurality of production apparatuses, such as a sputtering apparatus, and the like, are connected with a central host computer via a LAN. Each production apparatus is provided with a cryopump, and an independent network, different from the network of the production apparatuses, is created among a plurality of cryopumps and a computer for maintenance management. Thereby, maintenance or management of the plurality of cryopumps is collectively performed.

However, in the aforementioned production management system, it is needed to newly install a computer for maintenance management and further to newly create another new network, thereby resulting in an increase in the cost for the system. Further, because the network is different from that of production apparatuses, the network is, after all, no more than a network for simply recording and managing operation states of the cryopumps, independently from the production apparatuses.

SUMMARY OF THE INVENTION

In view of the aforementioned circumstances, a purpose of the present invention is to provide a cryopump and a method of monitoring the cryopump in which an operation state of the cryopump, which is suitable for a vacuum apparatus in which the cryopump is mounted, can be monitored by using an existing cryopump control device.

A cryopump according to an embodiment of the present invention is one that pumps gas from a vacuum chamber in a vacuum apparatus performing vacuum processing. The cryopump comprises: a refrigerator; a cryopanel cooled by the refrigerator; and a controller configured to control an operating cycle of the heat cycle of the refrigerator (hereinafter, simply referred to as an "operating cycle") such that the cryopanel is controlled so as to have a target temperature. When an operating cycle of the refrigerator has reached a first determination reference, the controller monitors the operating cycle for a first determination period of time, and when the operating cycle has reached a second determination reference, which corresponds to a higher load than the first determination reference, the controller monitors a temperature of the cryopanel for a second determination period of time, which is shorter the first determination period of time.

According to the embodiment, an operating cycle of the refrigerator is controlled so as to maintain the cryopanel at a target temperature in accordance with a load change on the cryopanel, the load change occurring due to an operation state of the vacuum apparatus. A vacuum apparatus has two operation states. In one state a load is temporarily increased and in another state a high load is continuously provided. Accordingly, an operation state of the vacuum apparatus can be estimated by monitoring a change in an operating cycle in terms of quantity and period of time. Also, it becomes possible to distinguish a change in an operation state of the vacuum apparatus from a malfunction in the cryopump. Further, the monitoring can be performed more accurately by using temperature monitoring in combination.

The first determination period of time may be set to be longer than a baking period of time necessary for baking processing in which the vacuum chamber is heated such that gas is discharged, and the second determination period of time to be shorter than the baking period of time.

The controller may start counting the first determination period of time since the operating cycle has reached a first reference cycle, and continuously monitor until the operating cycle becomes below a second reference cycle lower than the first reference cycle.

The first reference cycle may be set to a value higher than the maximum operating cycle assumed during the vacuum processing.

The controller may monitor a temperature of the cryopanel when the operating cycle has reached a third reference cycle higher than the first reference cycle.

The cryopanel may include a first stage cryopanel and a second stage cryopanel cooled to a lower temperature than the first stage cryopanel. When a state in which each of an operating cycle of the refrigerator, a temperature of the first stage cryopanel, and that of the second stage cryopanel exceeds a threshold value, has been continued for a preset period of time or longer while controlling the first stage cryopanel to have a target temperature, the controller may determine that a malfunction has occurred in the refrigerator.

When a state in which both of an operating cycle of the refrigerator and a temperature of the first stage cryopanel exceed their threshold values, has been continued for the preset period of time or longer, and when a temperature of the second stage cryopanel has returned within the preset period of time, the controller may determine that baking processing is being performed in the vacuum apparatus.

Another embodiment of the present invention is a method of monitoring a cryopump. The method is used for monitoring a cryopump that evacuates a vacuum apparatus performing vacuum processing. The method comprises: monitoring an operating cycle of a refrigerator for a first determination period of time when the operating cycle thereof has reached a first determination reference while performing variable control of operating cycle for controlling an operating cycle of the refrigerator such that the cryopanel has a target temperature; and monitoring a temperature of the cryopanel for a second determination period of time, which is shorter than the first determination period of time, when the operating cycle thereof has reached a second determination reference, corresponding to a higher load than the first determination reference, while performing the variable control of operating cycle.

BRIEF DESCRIPTION OF THE DRAWINGS

Embodiments will now be described, by way of example only, with reference to the accompanying drawings, which are meant to be exemplary, not limiting, and wherein like elements are numbered alike in several figures, in which.

DETAILED DESCRIPTION OF THE INVENTION

Figure 1:
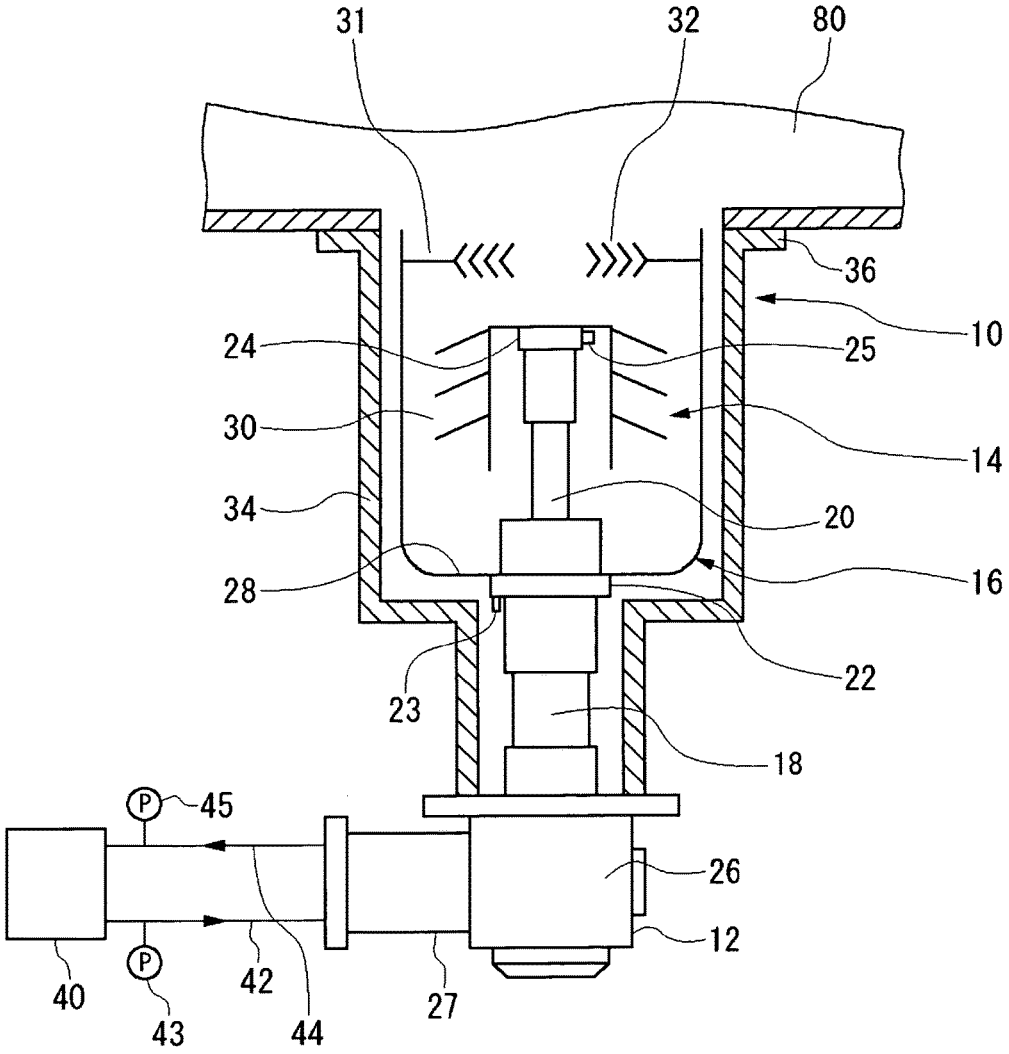
FIG. 1 is a cross-sectional view schematically illustrating a cryopump according to an embodiment of the present invention.

The invention will now be described by reference to the preferred embodiments. This does not intend to limit the scope of the present invention, but to exemplify the invention.

In an embodiment, a cryopump is fixed to a vacuum chamber in a vacuum apparatus in order to pump gas from the vacuum chamber. The vacuum apparatus is used for performing desired vacuum processing. The vacuum processing is, for example, surface processing in which the surface of a material to be processed is treated in a vacuum environment. Examples the vacuum apparatus include, for example, film-forming apparatuses, such is as a sputtering apparatus, a CVD apparatus, and a vacuum evaporation apparatus; and other semiconductor manufacturing apparatuses requiring vacuum environments. In a device manufacturing system including a vacuum apparatus, it is normally considered that the vacuum apparatus is a superior apparatus and a cryopump is one inferior to that.

Apart from a controller of the cryopump, the vacuum apparatus is usually provided with a controller for executing and managing desired vacuum processing. The controller of the vacuum apparatus and the controller of the cryopump may be communicatably connected with each other through an appropriate interface or network. In this case, however, it is sometimes designed to not transmit information on an operation state of the vacuum apparatus from the main controller of the vacuum apparatus to the controller of the subordinate cryopump.

Besides vacuum processing, the vacuum apparatus has sometimes an operation state of continuously providing a load to the cryopump, the load being higher than in the vacuum processing. An example of an operation state of providing such a high heat load to the cryopump includes baking processing of the vacuum apparatus. In general, the baking processing means one for discharging adsorbed gas, etc, to the outside by heating the vacuum chamber in the vacuum apparatus.

When variably controlling an operating cycle of a refrigerator so as to maintain a cryopanel at a target temperature, the operating cycle varies in accordance with a heat load provided to the cryopump. The heat load also varies depending on an operation state of the vacuum apparatus. The vacuum apparatus has two operation states. In one state, a heat load provided to the cryopump is increased for a short period of time (e.g., vacuum processing). In another state, a heat load is increased for a longer period of time and to a higher value (e.g., baking processing) than the former state. Accordingly, by monitoring a magnitude of a change in an operating cycle of the refrigerator and a continued period of time of the change in combination, an operation state of the vacuum apparatus can be estimated. Also, it becomes possible to distinguish a change in an operation state of the vacuum apparatus from a malfunction in the cryopump.

In an embodiment, a controller of a cryopump controls a temperature of a cryopanel such that the volume of a vacuum chamber, etc., the volume being to be evacuated, has a target degree of vacuum. The controller provides an operation command to a refrigerator thermally connected with the cryopanel such that an actual temperature of the cryopanel follows a target temperature. The refrigerator generates a cold state by a heat cycle in which the refrigerator inhales an operating gas and discharges the gas that has been expanded inside the refrigerator. The controller uses, for example, a heat cycle frequency of the refrigerator as the operation command. In this case, the controller determines a command value of the heat cycle frequency such that an actual temperature of the cryopanel follows the target temperature, and provides the command value to the refrigerator. Thereby, the refrigerator is operated in accordance with the frequency command value during a normal operation.

The refrigerator includes a passage switching mechanism for periodically switching the passage for the operating gas in order to periodically repeat inhale and discharge of the operating gas. The passage switching mechanism includes, for example, a valve portion and a drive portion driving the valve portion. The valve portion is, for example, a rotary valve, and the drive portion is a motor for rotating the rotary valve. The motor may be, for example, an AC motor or a DC motor. The passage switching mechanism may be a direct acting mechanism driven by a linear motor.

The controller may determine a command value for a rotational speed of the motor instead of determining a command value for the heat cycle frequency. In the case of a so-called direct drive method for directly transmitting a rotational output of the motor to the valve portion, a rotational speed of the motor matches a heat cycle frequency. When the motor is connected with the valve portion through a power transmission mechanism including reduction gears, etc., there is a certain relationship between a rotational speed of the motor and a cycle frequency. In this case, the controller determines, as a command value, a rotational speed of the motor corresponding to a heat cycle frequency necessary for making a temperature of the cryopanel follow the target temperature, and provides the command value to the refrigerator. Alternatively, when the refrigerator comprises a direct acting passage switching mechanism including a linear motor, the controller determines, as a command value, a frequency of the reciprocating movement of the linear motor, the frequency thereof corresponding to a heat cycle frequency necessary for making a temperature of the cryopanel follow the target temperature, and provides the command value to the refrigerator. In the following descriptions, for convenience, a rotational speed of the rotary motor and a frequency of the reciprocating movement of the linear motor are collectively referred to as an operating cycle of a motor in some cases.

In an embodiment according to the present invention, a controller of a cryopump monitors an operation state of the cryopump under a plurality of monitoring conditions each having a time width different from others. The controller may control the cryopump by using, for example, the following three monitoring conditions in combination: a first monitoring condition under which an operation state is monitored for a short time width; a second monitoring condition under which an operation state is monitored for a medium time width; and a third monitoring condition under which an operation state is monitored for a long time width. Herein, the monitoring condition means, for example, that a state in which a temperature of the cryopanel is raised to a temperature higher than a reference is continuing for a predetermined period of time or longer. Under a monitoring condition for a short period of time, it may be determined that the monitoring condition has been satisfied when a temperature has reached the reference. As a time width of a monitoring condition becomes longer, a constraint on an operation state (e.g., temperature reference) may be made stricter. For example, a determination reference temperature in the second monitoring condition may be set to be lower than that in the first monitoring condition, and a determination reference temperature in the third monitoring condition lower than that in the second monitoring condition. Thus, by setting monitoring conditions in phases, an error between an operation state and a normal state of the cryopump can be accurately detected.

The cryopump may be provided with a plurality of cryopanels, each of which is cooled to a temperature different from others. For example, the cryopump may be provided with a low-temperature cryopanel and a high-temperature cryopanel. The controller may control one of the low-temperature cryopanel and the high-temperature cryopanel to have a target temperature and may also monitor a state of the other cryopanel under the aforementioned monitoring conditions.

For example, when a heater for adjusting a temperature of the cryopanel is attached to the cryopanel, the condition that a state in which a control command for the heater (e.g., current) is smaller than a reference is continued may be adopted as a monitoring condition, instead of directly measuring a temperature of the cryopanel. Alternatively, the condition that a state in which an operating cycle of the refrigerator exceeds a reference is continued may be adopted as a monitoring condition instead of a temperature of the cryopanel.

The controller may memorize that at least one of a plurality of monitoring conditions has been satisfied, or may outputs a warning when the monitoring condition has been satisfied. It is because there is the possibility that the performance of the cryopump may be deteriorated when the monitoring condition has been satisfied. Accordingly, when at least one of a plurality of monitoring conditions has been satisfied, the controller may diagnose that the performance of the cryopump may be degraded and recommend maintenance of the cryopump.

Hereinafter, preferred embodiments for carrying out the present invention will be further described in detail with reference to the drawings. FIG. 1 is a cross-sectional view schematically illustrating a cryopump 10 according to an embodiment of the present invention.

The cryopump 10 is mounted in a vacuum chamber 80 in, for example, an ion implantation apparatus and a sputtering apparatus, and is used for increasing a degree of vacuum within the vacuum chamber 80 to a level required in a desired process. For example, a high degree of vacuum of, for example, approximately $10^{-5}$ Pa to $10^{-8}$ Pa can be attained.

The cryopump 10 is provided with a first cryopanel cooled to a first cooling temperature level and a second cryopanel cooled to a second cooling temperature level lower than the first cooling temperature level. The first cryopanel condenses and captures gas having vapor pressure lower than ambient pressure at the first cooling temperature level so as to pump the gas accordingly. For example, the first cryopanel pumps gas having vapor pressure lower than reference vapor pressure (e.g., $10^{-8}$ Pa). The second cryopanel condenses and captures gas having vapor pressure lower than ambient pressure at the second cooling temperature level so as to pump the gas accordingly. In order to capture a non-condensable gas that cannot be condensed at the second temperature level due to high vapor pressure, an adsorption area is formed on the surface of the second cryopanel. The adsorption area is formed by, for example, providing an adsorbent on the panel surface. A non-condensable gas is adsorbed by the adsorption area cooled to the second temperature level and pumped.

The cryopump 10 illustrated in FIG. 1 is provided with a refrigerator 12, a panel assembly 14 and a heat shield 16. The panel assembly 14 includes a plurality of cryopanels, which are cooled by the refrigerator 12. A cryogenic temperature surface for capturing gas by condensation or adsorption so as to pump the gas, is formed on the panel surface. The surface (e.g., rear face) of the cryopanel is normally provided with an adsorbent such as activated carbon or the like in order to adsorb gas.

The cryopump 10 is a so-called vertical-type cryopump, where the refrigerator 12 is inserted and arranged along the axial direction of the heat shield 16. The present invention is also applicable to a so-called horizontal-type cryopump alike, where the second cooling stage of the refrigerator is inserted and arranged in the (usually orthogonal) direction intersecting with the axial direction of the heat shield 16.

The refrigerator 12 is a Gifford-McMahon refrigerator (so-called GM refrigerator). The refrigerator 12 is a two-stage refrigerator comprising a first stage cylinder 18, a second stage cylinder 20, a first cooling stage 22, a second cooling stage 24 and a refrigerator motor 26. The first stage cylinder 18 and the second stage cylinder 20 are connected in series, in which a first stage displacer and a second stage displacer (not illustrated), which are connected together, are respectively built in. A regenerator is incorporated into the first stage displacer and the second stage displacer. The refrigerator 12 may be one other than the two-stage GM refrigerator, for example, a single-stage GM refrigerator or a pulse tube refrigerator may be used.

The refrigerator motor 26 is provided at one end of the first stage cylinder 18. The refrigerator motor 26 is provided inside a motor housing 27 formed at the end portion of the first stage cylinder 18. The refrigerator motor 26 is connected to the first stage displacer and the second stage displacer such that the first stage displacer and the second stage displacer can reciprocally move inside the first stage cylinder 18 and the second stage cylinder 20, respectively. The refrigerator motor 26 is connected to a movable valve (not illustrated) provided inside the motor housing 27 such that the valve can move in the forward direction and the reverse direction.

The first cooling stage 22 is provided at the end portion of the first stage cylinder 18 on the second stage cylinder 20 side, i.e., at the connecting portion between the first, stage cylinder 18 and the second stage cylinder 20. The second cooling stage 24 is provided at the terminal portion of the second stage cylinder 20. The first cooling stage 22 and the second cooling stage 24 are respectively fixed to the first stage cylinder 18 and the second stage cylinder 20 by, for example, brazing.

The compressor 40 is connected to the refrigerator 12 through a high pressure piping 42 and a low pressure piping 44. The high pressure piping 42 and the low pressure piping 44 are provided with a first pressure sensor 43 and a second pressure sensor 45 for measuring pressure of the operating gas, respectively. Instead of respectively providing pressure sensors in the high pressure piping 42 and the low pressure piping 44, it is possible that a differential pressure sensor, which is used for measuring the differential pressure between the high pressure piping 42 and the low pressure piping 44, is provided in a passage provided for connecting the two pipings 42 and 44 together.

The refrigerator 12 expands within it an operating gas (e.g., helium) with high pressure supplied from the compressor 40 so as to generate a cold state at the first cooling stage 22 and the second cooling stage 24. The compressor 40 recovers the operating gas expanded inside the refrigerator 12 and repressurize the gas to supply to the refrigerator 12.

Specifically, the operating gas with high pressure is supplied to the refrigerator 12 from the compressor 40 through the high pressure piping 42. At the time, the refrigerator motor 26 drives the movable valve inside the motor housing 27 such that the high pressure piping 42 and the inside space of the refrigerator 12 are connected to each other. When the inside space of the refrigerator 12 is filled with the operating gas with high pressure, the inside space of the refrigerator 12 is connected to the low pressure piping 44 with the refrigerator motor 26 switching the movable valve. Thereby, the operating gas is expanded and recovered into the compressor 40. Synchronized with the operation of the movable valve, the first stage displacer and the second stage displacer reciprocally move inside the first stage cylinder 18 and the second stage cylinder 20, respectively. By repeating such heat cycles, the refrigerator 12 generates cold states in the first cooling stage 22 and the second cooling stage 24. In the compressor 40, compression cycles in which the operating gas discharged from the refrigerator 12 is compressed to high pressure and delivered into the refrigerator 12, are repeated.

The second cooling stage 24 is cooled to a temperature lower than that of the first cooling stage 22. The second cooling stage 24 is cooled to, for example, approximately 10 K to 20 K, while the first cooling stage is cooled to, for example, approximately 80 K to 100 K. A first temperature sensor 23 is mounted in the first cooling stage 22 in order to measure a temperature thereof, and a second temperature sensor 25 is mounted in the second cooling stage 24 in order to measure a temperature thereof.

The heat shield 16 is fixed to the first cooling stage 22 of the refrigerator 12 in a thermally connected state, while the panel assembly 14 is connected to the second cooling stage 24 thereof in a thermally connected state. Thereby, the heat shield 16 is cooled to a temperature nearly equal to that of the first cooling stage 22, while the panel assembly is cooled to a temperature nearly equal to that of the second cooling stage 24.

The heat shield 16 is provided to protect the panel assembly 14 and the second cooling stage 24 from ambient radiation heat. The heat shield 16 is formed into a cylindrical shape having an opening 31 at its one end. The opening 31 is defined by the interior surface at the end of the cylindrical side face of the heat shield 16.

On the other hand, on the side opposite to the opening 31, i.e., at the other end on the pump bottom side, of the heat shield 16, an occluded portion 28 is formed. The occluded portion 28 is formed by a flange portion extending toward the inside of the radial direction at the end portion on the pump bottom side of the cylindrical side face of the heat shield 16. As the cryopump 10 illustrated in FIG. 1 is a vertical-type cryopump, the flange portion is mounted in the first cooling stage 22 of the refrigerator 12. Thereby, a cylindrically-shaped inside space 30 is formed within the heat shield 16. The refrigerator 12 protrudes into the inside space 30 along the central axis of the heat shield 16, and the second cooling stage 24 remains inserted in the inside space 30.

In the case of a horizontal-type cryopump, the occluded portion 28 is usually occluded completely. The refrigerator 12 is arranged so as to protrude into the inside space 30 along the direction orthogonal to the central axis of the heat shield 16 from the opening for attaching the refrigerator, formed on the side face of the heat shield 16. The first cooling stage 22 of the refrigerator 12 is mounted in the opening for attaching the refrigerator in the heat shield 16, while the second cooling stage 24 thereof is arranged in the inside space 30. In the second cooling stage 24, is mounted the panel assembly 14. Therefore, the panel assembly 14 is arranged in the inside space 30 of the heat shield 16. Alternatively, the panel assembly 14 may be mounted in the second cooling stage 24 through an appropriately-shaped panel mounting member.

The heat shield 16 may not be cylindrical in shape but may be a tube having a rectangular, elliptical, or any other cross section. Typically, the shape of the heat shield 16 is analogous to the shape of the interior surface of a pump case 34. The heat shield 16 may not be formed as a one-piece cylinder as illustrated. A plurality of parts may form a cylindrical shape as a whole. The plurality of parts may be provided so as to create a gap between the parts.

A baffle 32 is provided in the opening 31 of the heat shield 16. The baffle 32 is provided spaced apart from the panel assembly 14 in the direction of the central axis of the heat shield 16. The baffle 32 is mounted in the end portion on the opening 31 side of the heat shield 16, and is cooled to a temperature nearly equal to that of the heat shield 16. The baffle 32 may be formed, for example, concentrically, or into other shapes such as a lattice shape, etc., when seen from the vacuum chamber 80 side. A gate valve (not illustrated) is provided between the baffle 32 and the vacuum chamber 80. The gate valve is, for example, closed when the cryopump 10 is regenerated and opened when the vacuum chamber 80 is evacuated by the cryopump 10.

The heat shield 16, the baffle 32, the panel assembly 14, and the first cooling stage 22 and the second cooling stage 24 of the refrigerator 12, are contained inside the pump case 34. The pump case 34 is formed by connecting in series two cylinders, diameters of which are different from each other. The end portion of the cylinder with a larger diameter is opened, and a flange portion 36 for connection with the vacuum chamber 80 is formed extending toward the outside of the radial direction. The end portion of the cylinder with a smaller diameter of the pump case 34 is fixed to the motor housing 27. The cryopump 10 is fixed to an evacuation opening of the vacuum chamber 80 in an airtight manner through the flange portion 36 of the pump case 34, allowing an airtight space integrated with the inside space of the vacuum chamber 80 to be formed.

The pump case 34 and the heat shield 16 are both formed into cylindrical shapes and arranged concentrically. Because the inner diameter of the pump case 34 is slightly larger than the outer diameter of the heat shield 16, the heat shield 16 is arranged slightly spaced apart from the interior surface of the pump case 34.

Figure 2:
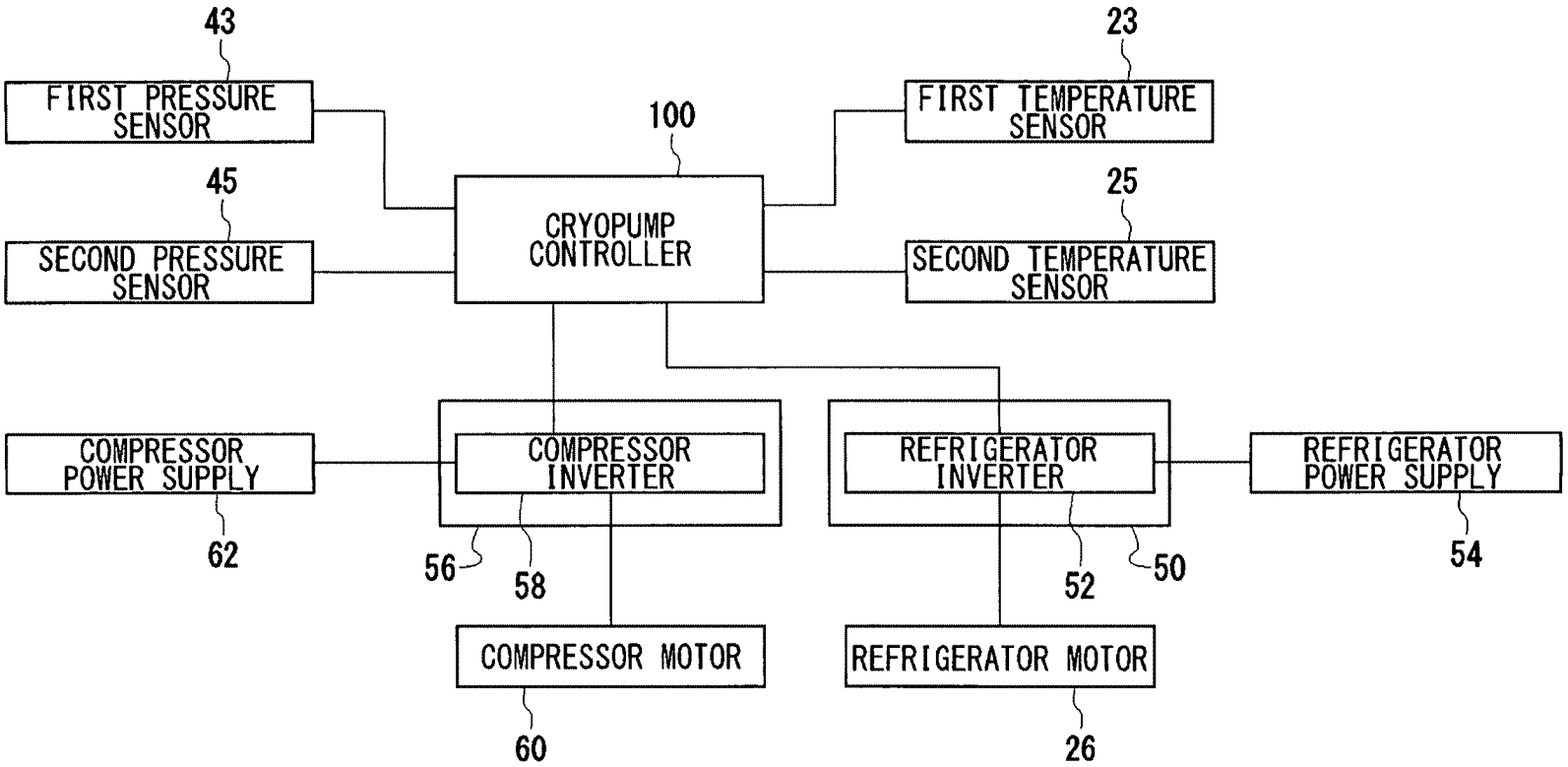
FIG. 2 is a control block view with respect to the cryopump according to the present embodiment.

FIG. 2 is a control block view with respect to the cryopump 10 according to the present embodiment. A cryopump controller (hereinafter, also referred to as a CP controller) 100, which is used for controlling the cryopump 10 and the compressor 40, is provided associated with the cryopump 10. The CP controller 100 comprises: a CPU performing various arithmetic processing, a ROM storing various control programs, a RAM used as a work area for storing data and executing programs, an input/output interface, and a memory, etc. The CP controller 100 may be configured to be integrated with the cryopump 10, or configured separately from the cryopump 10 to be operable to communicate with each other.

In FIGS. 1 and 2, a vacuum evacuation system provided with each one of the cryopump 10 and the compressor 40 is illustrated; however, a vacuum evacuation system provided with a plurality of the cryopumps 10 and a plurality of the compressors 40, respectively, may also be configured in the present embodiment. To attain such a system, the CP controller 100 may be configured such that a plurality of the cryopumps 10 and a plurality of the compressors 40 can be connected thereto.

To the CP controller 100, are connected a first temperature sensor 23 for measuring a temperature of the first cooling stage 22 of the refrigerator 12 and a second temperature sensor 25 for measuring a temperature of the second cooling stage 24 thereof. The first temperature sensor 23 periodically measures a temperature of the first cooling stage 22 to output a signal indicating the measured temperature to the CP controller 100. The second temperature sensor 25 periodically measures a temperature of the second cooling stage 24 to output a signal indicating the measured temperature to the CP controller 100. The measured values obtained by the first temperature sensor 23 and the second temperature sensor 25 are inputted to the CP controller 100 at predetermined intervals and stored in a predetermined storage area of the CP controller 100.

To the CP controller 100, are connected a first pressure sensor 43 used for measuring operating gas pressure on the discharge side, i.e., on the high pressure side of the compressor 40, and a second pressure sensor 45 used for measuring the operating gas pressure on the inhale side, i.e., on the low pressure side thereof. The first pressure sensor 43 periodically measures, for example, the pressure in the high pressure piping 42 to output a signal indicating the measured pressure to the CP controller 100. The second pressure sensor 45 periodically measures, for example, the pressure in the low pressure piping 44 to output a signal indicating the measured pressure to the CP controller 100. The measured values obtained by the first pressure sensor 43 and the second pressure sensor 45 are inputted to the CP controller 100 at predetermined intervals and stored in a predetermined storage area of the CP controller 100.

The CP controller 100 is connected to a refrigerator frequency converter 50 so as to be operable to communicate therewith. The refrigerator frequency converter 50 and the refrigerator motor 26 are connected to each other so as to be operable to communicate with each other. The CP controller 100 transmits a control command to the refrigerator frequency converter 50. The refrigerator frequency converter 50 is configured to include a refrigerator inverter 52. The refrigerator frequency converter 50 is supplied with electric power with the specified voltage and frequency from a refrigerator power supply 54, and supplies the electric power to the refrigerator motor 26 after adjusting the voltage and frequency of the supplied electric power based on the control command transmitted by the CP controller 100.

The CP controller 100 is connected to a compressor frequency converter 56 so as to be operable to communicate therewith. The compressor frequency converter 56 and a compressor motor 60 are connected to each other so as to be operable to communicate with other. The CP controller 100 transmits a control command to the compressor frequency converter 56. The compressor frequency converter 56 is configured to include a compressor inverter 58. The compressor frequency converter 56 is supplied with electric power with the specified voltage and frequency from a compressor power supply 62, and supplies the electric power to the compressor motor 60 after adjusting the voltage and frequency of the supplied electric power based on the control command transmitted by the CP controller 100. In the embodiment illustrated in FIG. 2, the refrigerator power supply 54 and the compressor power supply 62 are provided separately for each of the refrigerator 12 and the compressor 40; however, a common power supply between the refrigerator 12 and the compressor 40 may be provided.

The CP controller 100 controls the refrigerator 12 based on a temperature of the cryopanel. The CP controller 100 issues an operation command to the refrigerator 12 such that an actual temperature of the cryopanel follows the target temperature. For example, the CP controller 100 controls an operating cycle of the refrigerator motor 26 by performing feedback control so as to minimize a deviation between the target temperature of the first stage cryopanel and a measured temperature obtained by the first temperature sensor 23. The target temperature of the first stage cryopanel is determined as a specification, for example, in accordance with a process carried out in the vacuum chamber 80. In this case, the second cooling stage 24 and the panel assembly 14 of the refrigerator 12 are cooled to a temperature determined by the specification of the refrigerator 12 and an external heat load. The CP controller 100 determines an operating cycle of the refrigerator motor 26 (e.g., rotational speed of the motor) such that an actual temperature of the first stage cryopanel follows the target temperature, and outputs a command value for the motor operating cycle to the refrigerator inverter 52. The CP controller 100 may control an operating cycle of the refrigerator motor 26 such that an actual temperature of the second stage cryopanel follows the target temperature.

Thereby, if a measured temperature obtained by the first temperature sensor 23 is higher than the target temperature, the CP controller 100 outputs a command value to the refrigerator frequency converter 50 so as to increase an operating cycle of the refrigerator motor 26. In response to an increase in a motor operating cycle, a heat cycle frequency in the refrigerator 12 is increased, allowing the first cooling stage 22 of the refrigerator 12 to be cooled toward the target temperature. In contrast, if a measured temperature obtained by the first temperature sensor 23 is lower than the target temperature, an operating cycle of the refrigerator motor 26 is decreased, allowing the first cooling stage 22 of the refrigerator 12 to be heated toward the target temperature.

The target temperature of the first cooling stage 22 is usually set to a constant value. Therefore, the CP controller 100 outputs, when a heat load on the cryopump 10 is increased, a command value so as to increase an operating cycle of the refrigerator motor 26, while outputs, when a heat load on the cryopump 10 is decreased, a command value so as to decrease an operating cycle thereof. The target temperature may be appropriately changed, for example, the target temperature of the cryopanel may be sequentially set so as to attain target ambient pressure in the volume to be evacuated.

In a typical cryopump, a heat cycle frequency is always maintained at a constant value. The heat cycle frequency is set so as to operate the cryopump with a relatively larger cycle such that rapid cooling from room temperature to a temperature at which the pump is operated can be attained. If an external heat load is small, a temperature of the cryopanel is adjusted by heating with a heater, thereby causing consumed electric power to be large. In contrast, in the present embodiment, a heat cycle frequency is controlled in accordance with a heat load on the cryopump 10, and hence a cryopump excellent in energy saving can be realized. Further, there is not any need for providing a heater, which also contributes to reduction of the consumed power.

The CP controller 100 controls a compression cycle frequency executed in the compressor 40 so as to maintain the differential pressure (hereinafter, sometimes referred to as compressor differential pressure) between the pressures at the inlet port and the outlet port of the compressor 40, at the target pressure. For example, the CP controller 100 controls a compression cycle frequency by performing feedback control so as to maintain the differential pressure between the pressures at the inlet port and the outlet port of the compressor 40, at a constant value. Specifically, the CP controller 100 determines the compressor differential pressure from measured values obtained by the first pressure sensor 43 and the second pressure sensor 45. The CP controller 100 determines an operating cycle of the compressor motor 60 (e.g., rotational speed of the motor) such that the compressor differential pressure is to be equal to the target value, and outputs the command value for the motor operating cycle to the compressor frequency converter 56.

With such a constant differential pressure control method, the consumed power can be further reduced. If heat loads on the cryopump 10 and the refrigerator 12 are small, a heat cycle frequency of the refrigerator 12 is made small due to the aforementioned temperature control of the cryopanel. Then, because a flow rate of the operating gas required in the refrigerator 12 becomes small, the differential pressure between the pressures at the inlet port and the outlet port of the compressor 40 is likely to expand. In the present embodiment, however, an operating cycle of the compressor motor 60 is controlled so as to maintain the compressor differential pressure at a constant value, allowing a compression cycle frequency to be adjusted. Therefore, an operating cycle of the compressor motor 60 becomes small in this case. Accordingly, the consumed power can be further reduced when compared to the case where a compression cycle is always maintained at a constant value as in a typical cryopump.

On the other hand, if a heat load on the cryopump 10 becomes large, an operating cycle and a compression cycle frequency of the compressor motor 60 are increased so as to maintain the compressor differential pressure at a constant value. Hence, a flow rate of the operating gas flowing into the refrigerator 12 can be sufficiently secured, thereby allowing an error between a temperature of the cryopanel and the target temperature, the error occurring due to an increase in a heat load, to be suppressed to a minimum.

An operation of the cryopump 10 with the aforementioned structure will be described below. In operating the cryopump 10, the inside of the vacuum chamber 80 is evacuated to the degree of approximately 1 Pa by using other appropriate roughing pump prior to its operation. Subsequently the cryopump 10 is operated. The first cooling stage 22 and the second cooling stage 24 are cooled by driving the refrigerator 12, allowing the heat shield 16, the baffle 32 and the panel assembly 14, which are thermally connected to the stages, also to be cooled.

The cooled baffle 32 cools gas molecules flying toward the inside of the cryopump 10 from the vacuum chamber 80 to condense gas (e.g., moisture), vapor pressure of which is sufficiently low at the cooling temperature, on its surface and pump the gas. Gas, vapor pressure of which is not sufficiently low at the cooling temperature of the baffle 32, passes through the baffle 32 to enter the inside of the heat shield 16. Among the gas molecules thus entering the inside, gas (e.g., argon), vapor pressure of which is sufficiently low at the cooling temperature of the panel assembly 14, is condensed on the surface of the structure 14 to be pumped. Gas (e.g., hydrogen), vapor pressure of which is not sufficiently low at the cooling temperature, is adsorbed by an adsorbent, which is attached to the surface of the panel assembly 14 and cooled, and pumped. Thus, the cryopump 10 can enhance the degree of vacuum inside the vacuum chamber 80 to a required level.

In an embodiment, a limit value of a temperature of the cryopanel may be set in the controller of the vacuum apparatus in order to display a warning or to discontinue a vacuum process when a temperature of the cryopanel is abnormally raised. A panel limit temperature set in the vacuum apparatus is, for example, a temperature from which it can be clearly considered that a malfunction has occurred in the cryopump. Accordingly, it can be assumed that the cryopump in the vacuum apparatus is being normally operated as long as a temperature of the cryopanel has not reached the panel limit temperature.

The controller of the vacuum apparatus determines whether an input temperature exceeds the limit temperature after receiving an input of a panel temperature from the cryopump. When exceeding the limit temperature, the controller outputs a warning or discontinues a vacuum process under execution. When a vacuum process is discontinued immediately after a temperature of the cryopanel has reached the panel limit temperature, there accidently occurs down time of the vacuum apparatus. Such an accidental occurrence of down time is not preferred because a planned process execution schedule is hampered. Then, it is preferable that a monitoring function or a self-diagnose function is installed in the cryopump to monitor an operating state of the cryopump.

In an embodiment, a controller of a cryopump may determine, while controlling a high-temperature cryopanel to have a target temperature, whether a temperature of a low-temperature cryopanel cooled in conjunction with the high-temperature cryopanel has approached an upper limit temperature of the low-temperature cryopanel set in a vacuum apparatus. Specifically, the controller may determine whether the cryopanel is heated to, for example, a temperature higher than or equal to an alert temperature set to be lower than the upper limit temperature of the cryopanel set in the vacuum apparatus. The controller may outputs a warning and display the warning on an associated display portion when the cryopanel is heated to a temperature higher than or equal to the alert temperature.

With such a structure, it can be detected beforehand in the cryopump that there is the possibility that an actual temperature of the cryopanel may reach the cryopanel upper limit set temperature in the vacuum apparatus. Thereby, the vacuum apparatus can be suitably dealt with, for example, in the next maintenance. By monitoring the cryopump under a monitoring condition made suitable for the setting of the vacuum apparatus, an accidental occurrence of down time of the vacuum apparatus can be suppressed to a minimum.

Further, the controller of the cryopump may determine, while controlling the temperature of the high-temperature cryopanel, whether an error between a temperature of the low-temperature cryopanel and a temperature zone in which it is assured that the vacuum processing is normally performed (hereinafter, also referred to as a "vacuum process assured temperature zone") continuously occurs. For example, the controller may determine whether the low-temperature cryopanel is continuously being heated to a temperature within a temperature range for a preset period of time or longer, the temperature range being set on condition that the aforementioned alert temperature is an upper limit.

Therefore, the alert temperature may be set to be higher than the vacuum process assured temperature zone.

It is not dependent only on a temperature of the cryopanel, but on various parameters, for example, such as pressure in the chamber, a temperature in the chamber, a flow rate of the process gas, a discharge current, and a film-forming material, etc., whether a vacuum process is normally performed. Rather, there may be the possibility that a temperature of the cryopanel may not provide a major influence on the process in comparison with other factors. Accordingly, it cannot be always said that, even when an error between a temperature of the cryopanel and the process assured temperature zone occurs, there immediately occurs a malfunction in the process. However, when an error between a temperature of the cryopanel and the process assured temperature zone continuously occurs, it cannot be denied the possibility that a certain extent of influence may occur. By monitoring the cryopump under a monitoring condition made suitable for a vacuum process in which the cryopump executes a pumping operation, the possibility that the vacuum process may be adversely affected by the cryopump can be suppressed to a minimum.

The controller of the cryopump may determine, while controlling a temperature of the high-temperature cryopanel, whether a state in which an error between a temperature of the low-temperature cryopanel and the minimum attained temperature thereof occurs, has been continued for a long period of time. For example, the controller may determine whether a state in which an error between a temperature of the low-temperature cryopanel during a pumping operation and the minimum attained temperature thereof measured in the initial stage of an operation of the cryopump occurs, has been continued for a predetermined continued period of time or longer. A reference temperature by which it is determined whether an error between a temperature of the low-temperature cryopanel during a pumping operation and the minimum attained temperature in the initial stage of an operation of the cryopump occurs, may be set in the vacuum process assured temperature zone.

A state in which a temperature of the low-temperature cryopanel is within the vacuum process assured temperature zone is a normal state. However, there is a certain degree of variation in the minimum attained temperatures of the cryopanel, depending on individual differences of the cryopumps. There is a tendency in which, as an accumulative operating period of time of the cryopump becomes long, the minimum attained temperature is gently increased in comparison with that in the initial stage of an operation thereof. It is preferable that the minimum attained temperature in the initial stage of an operation has been a low temperature, because it can be expected that a temperature of the cryopanel may remain within the vacuum process assured temperature zone for a long period of time. However, even if a temperature of the low-temperature cryopanel is within a normal range, there is the possibility that aging degradation of the cryopump may be in progress when an error from the minimum attained temperature in the initial stage has expanded. Due to the progress in the aging degradation, a risk of occurrence of a malfunction becomes high. By monitoring an error between a temperature of the low-temperature cryopanel and the minimum attained temperature in the initial stage of an operation, it can be sped up to confirm a state of the cryopump before an adverse influence on the vacuum process comes to the surface.

The controller of the cryopump may determine, while controlling a temperature of the high-temperature cryopanel, whether a state in which an operating cycle of the refrigerator exceeds a reference has been continued. For example, the controller may determine whether a state in which an operating cycle of the refrigerator exceeds the operating cycle, which is a determination reference, has been continued for a determination period of time or longer. The determination period of time may be set to be longer than a period of time necessary for the baking processing of the vacuum apparatus. With such a setting, it becomes possible to distinguish an increase in an operating cycle of the refrigerator due to the baking processing of the vacuum apparatus from a continuous increase in an operating cycle of the refrigerator due to aging degradation in the performance of the cryopump.

In this case, the determination reference cycle may be higher than the maximum operating cycle assumed during the vacuum processing. Alternatively, the determination reference cycle may be higher than the maximum operating cycle in a no-load operation of the cryopump. The no-load operation means, for example, a pumping operation in which a desirable degree of vacuum is attained from the predetermined initial pressure while a continued gas flow into the cryopump is being stopped. Alternatively, the determination reference frequency may be lower than the upper limit operating cycle of the refrigerator. Alternatively, a monitoring start operating cycle and a monitoring cancel operating cycle may be different from each other. For example, the monitoring start operating cycle may be higher than the monitoring cancel operating cycle. Both the monitoring start operating cycle and the monitoring cancel operating cycle may be higher than the maximum operating cycle assumed during the vacuum processing and lower than the upper limit operating cycle of the refrigerator.

The controller of the cryopump may monitor, while controlling a temperature of the high-temperature cryopanel, a temperature of the high-temperature cryopanel when an operating cycle of the refrigerator approaches or have reached the upper limit. The upper limit may be the maximum value of an operating cycle range allowed for the refrigerator. The controller may determine whether a state in which, for example, an error between a temperature of the high-temperature cryopanel and a target temperature thereof is continuously occurring since the operating cycle has reached the upper limit. In this case, the controller may determine whether a state in which a temperature of the high-temperature cryopanel has raised to a temperature higher than a threshold temperature, which is higher than the target temperature, has been continued for a determination period of time or longer. The determination period of time may be set to be shorter than a period of time necessary for the baking processing of the vacuum apparatus. The threshold temperature may be lower than the upper limit temperature set in the vacuum apparatus, or be included within the vacuum process assured temperature zone with respect to the high-temperature cryopanel. The fact that an operating cycle has almost reached the upper limit and an error between a temperature of the cryopanel and the target temperature occurs is considered that the refrigerating capacity of the refrigerator does not keep up with an external heat load. Because it can be considered that the fact occurs due to the aging degradation in the performance of the cryopump, it is desirable to detect it by monitoring.

Figure 3:
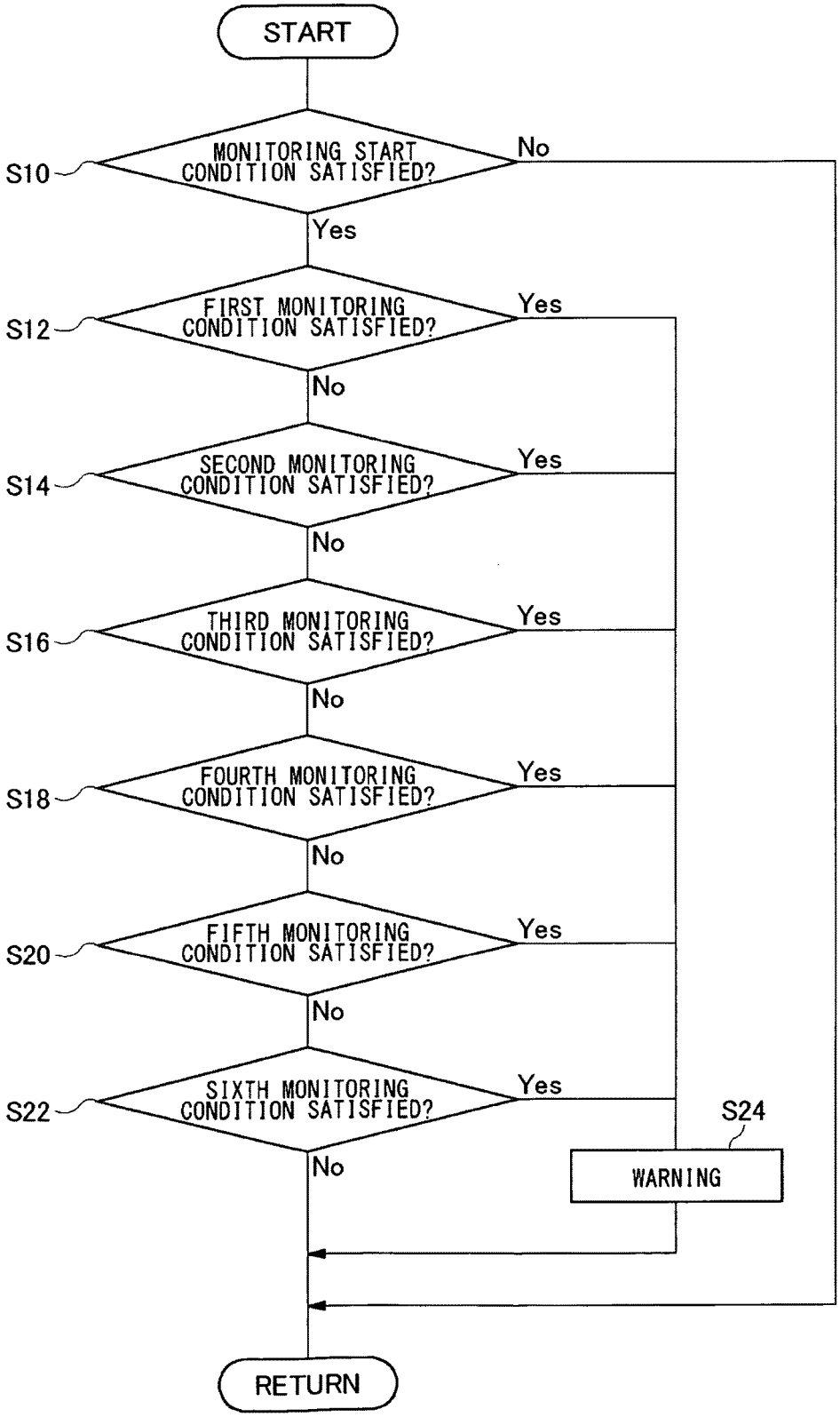
FIG. 3 is a flowchart for illustrating an example of monitoring processing according to the present embodiment.

FIG. 3 is a flowchart illustrating an example of monitoring processing according to the present embodiment. The processing illustrated in FIG. 3 is repeatedly performed at a predetermined cycle by the CP controller 100 during an operation of the cryopump 10. In short, the CP controller 100 outputs a warning when any one of the first to the third monitoring conditions is satisfied while a monitoring start condition is being satisfied. Although in the processing illustrated in FIG. 3, the first to the third monitoring conditions are sequentially determined in series, the order of determination may be arbitrarily interchanged with each other, or each monitoring condition may be determined in parallel. Alternatively, any one of the first to the sixth monitoring conditions may be omitted.

The CP controller 100 at first determines whether the monitoring start condition is satisfied (S10). Herein, the monitoring start condition means that a operation mode of the cryopump 10 is a T1 temperature control. An operation mode of the cryopump 10 is usually the T1 temperature control mode while the cryopump 10 is performing a pumping operation of the vacuum chamber 80. The T1 temperature control means that the refrigerator 12 is controlled such that a temperature T1 of the first stage cryopanel (namely, heat shield 16) will become the target temperature of the first stage. When it is determined that the monitoring start condition is not satisfied (S10/N), the CP controller 100 ends the processing without monitoring an operation state of the cryopump. Accordingly, when the cryopump 10 is, for example, in a stopped state or in a regenerative operation, the CP controller 100 does not perform the monitoring processing of the cryopump 10.

At the start of an operation, the cryopump 10 is at first driven in a cool-down step, then transferred to a pumping operation therefrom. It is desirable that the cryopanel is rapidly cooled in the cool-down step. Accordingly, the CP controller 100 may perform a T2 temperature control in the cool-down step and switch to the T1 temperature control when the second stage cryopanel has been cooled to approximately a second stage target temperature. The T2 temperature control means a control in which the second stage cryopanel (namely, panel assembly 14) is cooled to the second stage target temperature. At the time, the first stage cryopanel is sometimes cooled to a lower temperature than the first stage target temperature when switching to the T1 temperature control. Accordingly, the CP controller 100 may set the monitoring start condition as such that an operation mode of the cryopump is being in the T1 temperature control and a predetermined waiting period of time has passed since the switch to the T1 temperature control. The waiting period of time may be set to a period of time necessary for a temperature of the first stage cryopanel to be stabilized at a temperature near the first stage target temperature. In the following descriptions, a state in which the waiting period of time has passed and an operation mode is the T1 temperature control is sometimes referred to as a "T1 stable state".

When it is determined that the monitoring start condition is satisfied (S10/Y), the CP controller 100 determines whether the first monitoring condition is satisfied (S12). The first monitoring condition means that a temperature of the second stage cryopanel is raised to an alert temperature. The alert temperature is determined in conjunction with a malfunction determination temperature set in the vacuum apparatus in which the cryopump 10 is installed. The alert temperature is set to a low temperature so as to have an appropriate margin to the malfunction determination temperature in the vacuum apparatus. For example, when the malfunction determination temperature in the vacuum apparatus is 20 K, the alert temperature is set to be 18 K. When it is determined that the first monitoring condition is satisfied (S12/Y), the CP controller 100 outputs a warning (S24). With such a structure, the CP controller 100 can detect that a temperature of the cryopanel approaches the upper limit temperature before the temperature thereof is raised to the upper limit temperature of the cryopanel in the vacuum apparatus.

When it is determined that the first monitoring condition is not satisfied (S12/N), the CP controller 100 determines whether the second monitoring condition is satisfied (S14). When it is determined that the second monitoring condition is satisfied (S14/Y), the CP controller 100 outputs a warning (S24).

The second monitoring condition is that a temperature of the second stage cryopanel is continuously being raised to a temperature within a cautionary temperature range for a preset period of time or longer. The CP controller 100 starts timekeeping when a temperature of the second stage cryopanel has newly been raised to a temperature within the cautionary temperature range in the monitoring processing of this time. In the subsequent monitoring processing, the CP controller 100 determines whether a temperature of the second stage cryopanel remains in the cautionary temperature range. When remaining in the cautionary temperature range, the CP controller then determines whether the elapsed time exceeds a preset period of time. When exceeding the preset period of time, the CP controller 100 determines that the second monitoring condition is satisfied. When a temperature of the second stage cryopanel returns to a temperature lower than the cautionary temperature range in the subsequent monitoring processing, the CP controller resets the count of the elapsed time and determines that the second monitoring condition is not satisfied.

The preset period of time is set to, for example, approximately tens of minutes to several hours. The cautionary temperature range is one, the maximum of which is the alert temperature and the minimum of which is a cautionary temperature. The cautionary temperature is set, for example, to a temperature higher than or equal to the maximum of a process assured temperature zone in which it is assured that the vacuum process is normally performed. The cautionary temperature is, for example, 12 K to 15 K. It is noted that a malfunction does not always occur immediately after a temperature of the cryopanel has exceeded the process assured temperature zone.

Herein, the cautionary temperature may be included within a performance assured temperature range in which the pump performance of the cryopump 10 is assured. That is, the cryopump 10 can provide the pump performance specified in a specification even in a state in which a temperature of the second stage cryopanel has been raised to a temperature within the cautionary temperature zone. By setting the cautionary temperature in accordance with the vacuum process as stated above, suitable maintenance can be sped up even when the cryopump 10 itself is in a normal operation state. As a result, the possibility that the vacuum process may be adversely affected by the cryopump can be suppressed to a minimum.

When it is determined that the second monitoring condition is not satisfied (S14/N), the CP controller 100 determines whether a third monitoring condition is satisfied (S16). When it is determined that the third monitoring condition is satisfied (S16/Y), the CP controller 100 outputs a warning (S24).

The third monitoring condition means that a state in which an increase between a most recent minimum attained temperature of the second stage cryopanel and a minimum attained temperature thereof in the initial stage of an operation of the cryopump 10 exceeds an aging degradation determination threshold value, has been continued for a long period of time. The CP controller before memorizes the minimum attained temperature in the initial stage of an operation (also referred to as an "initial minimum attained temperature"). In the T1 stable state in the initial stage of an operation of the cryopump 10, the CP controller 10 measures temperatures of the second stage cryopanel multiple times when an operating cycle of the refrigerator 12 is lower than the reference value, and memorizes the lowest temperature as the minimum attained temperature. The minimum attained temperature may be measured for a certain period of time (e.g., one week or so) after a certain period of time (e.g., one week or so) has passed since the start of an operation of the cryopump 10 installed in the vacuum apparatus, assuming that the minimum attained temperature is not measured immediately after the start of an operation thereof.

Because there is a fear that an external heat load may be large when an operating cycle of the refrigerator 12 is high, it is expected that the temperature of a cryopanel does not become too low. Accordingly, in order to obtain a real minimum attained temperature, it is desirable to measure it when an operating cycle of the refrigerator 12 is smaller than the reference value. The operating cycle reference value may be made to be the maximum operating cycle expected during a pumping operation (or during a non-load operation) in the vacuum process, or be a value obtained by adding an appropriate margin to the maximum operating cycle. The effect of the description stated above is that, in other words, the minimum attained temperature is not measured while the baking processing is being executed in the vacuum apparatus. Because the vacuum apparatus is heated during the baking processing, there is an tendency in which an operating cycle of the refrigerator becomes high. It is noted that so-called idol baking may be included in the baking processing in which not only an occluded gas, etc., is discharged by heating the vacuum chamber, but also the vacuum apparatus is maintained in a warming-up state.

Further, the CP controller 100 measures the minimum attained temperature during a pumping operation under the same condition as that when the initial minimum attained temperature is measured. That is, when an operating cycle of the refrigerator 12 is lower than the reference value in the T1 stable state, the CP controller 100 measures and memorizes a temperature of the second stage cryopanel. When an increase between a measured minimum attained temperature and the initial minimum attained temperature exceeds the aging degradation determination threshold value in the monitoring processing of this time, the controller 100 starts timekeeping. The CP controller 100 determines, in the subsequent monitoring processing, whether an increase in the most recent measured minimum attained temperature continuously exceeds the aging degradation determination threshold value. When exceeding the threshold value, the CP controller 100 determines whether the elapsed time exceeds the aging degradation determination period of time. When exceeding the determination period of time, the CP controller 100 determines that the third monitoring condition is satisfied. When an increase in the measured minimum attained temperature has returned to a value smaller than the determination threshold value in the subsequent monitoring processing, the CP controller 100 resets the count of the elapsed time and determines that the third monitoring condition is not satisfied.

Herein, the aging degradation determination temperature, obtained by combining the initial minimum attained temperature with the aging degradation determination threshold value, may be included within the vacuum process assured temperature zone, or within a performance assured temperature zone in which the pump performance of the cryopump 10 is assured. That is, even if a recent minimum attained temperature of the second stage cryopanel is increased to the aging degradation determination temperature, the vacuum process is not at all affected by the cryopump 10 at the time, and the cryopump 10 can provide the pump performance specified in a specification. The aging degradation determination threshold value may be set to an appropriate value empirically and experimentally, for example, to a value from 2 K to 5 K.

An individual difference of each cryopump 10 is reflected on the initial minimum attained temperature. It is because the initial minimum attained temperature is measured with respect to each cryopump 10 after each cryopump 10 has been installed in the vacuum apparatus and its operation has been initialized. As the cryopump 10 has good performance, the initial minimum attained temperature becomes low. There is a tendency in which the minimum attained temperature is gently increased as an accumulative operating period of time of the cryopump becomes long. Accordingly, a cryopump having good performance can be used for a long period of time before the minimum attained temperature is raised to the aforementioned cautionary temperature zone, with an error between the most recent minimum attained temperature and the initial minimum attained temperature being increased.

When an error from the initial minimum attained temperature becomes large, it can be thought that aging degradation of the cryopump 10 is in progress. In such a case, there is the fear that a malfunction may accidentally occur in the cryopump 10 at worst due to accumulation of the aging degradation, without any sign from the monitoring of the vacuum process by using the controller of the vacuum apparatus. If a malfunction occurs in the cryopump 10, down time of the vacuum apparatus may be incurred, which is not desirable. However, by monitoring the cryopump 10 by using the aforementioned third monitoring condition, it can be detected that an error from the initial minimum attained temperature has expanded. Accordingly, it is desirable because maintenance of the cryopump can be sped up before an adverse influence on the vacuum process comes to the surface, or before accidental down time occurs in the vacuum apparatus.

Further, it is desirable that the aging degradation determination period of time is longer than, for example, the preset period of time of the second monitoring condition, and is more desirable that the aging degradation determination period of time is longer than the period of time necessary for the baking processing of the vacuum apparatus. By making the aging degradation determination period of time longer than the period of time necessary for the baking processing, it can be avoided that an increase in the temperature, occurring due to a heat input during the baking processing, may be mistaken for an increase in the temperature, occurring due to aging degradation. When the aging degradation determination period of time is made shorter than the period of time necessary for the baking processing, the CP controller 100 may be configured to output a warning, assuming that aging degradation actually occurs when the third monitoring conditions are continuously satisfied multiple times.

When it is determined that the third monitoring condition is not satisfied (S16/N), the CP controller 100 determines whether a fourth monitoring condition is satisfied (S18). When it is determined that the fourth monitoring condition is satisfied (S18/Y), the CP controller 100 outputs a warning (S24).

The fourth monitoring condition means that an operating cycle of the refrigerator motor 26 has been continuously increased to a cycle within a monitoring cycle range for a preset period of time or longer. The CP controller 100 starts timekeeping when an operating cycle has newly reached a monitoring start cycle in the monitoring processing of this time. The CP controller 100 determines whether an operating cycle exceeds a monitoring cancel cycle in the subsequent processing, and when exceeding the monitoring cancel cycle, the CP controller then determines whether the elapsed time has exceeded a preset period of time. When exceeding the preset period of time, the CP controller 100 determines that the fourth monitoring condition is satisfied. When an operating cycle has returned to a cycle lower than or equal to the monitoring cancel cycle, the count of the elapsed time is reset and determines that the fourth monitoring condition is not satisfied.

It is desirable that the preset period of time is longer than the period of time necessary for the baking processing of the vacuum apparatus, and is set to, for example, several hours to several days. Both the monitoring start cycle and the monitoring cancel cycle are set to be higher than the maximum operating cycle assumed during the vacuum processing and to be lower than the upper limit cycle allowed for the refrigerator motor 26. In addition, the monitoring start cycle is set to be higher than the monitoring cancel cycle. Thus, it can be estimated whether a continued increase in an operating cycle of the refrigerator motor 26 has occurred due to the degradation in the performance of the cryopump, which is associated with the first stage cryopanel, or due to the baking processing in the vacuum apparatus.

When it is determined that the fourth monitoring condition is not satisfied (S18/N), the CP controller 100 then determines whether a fifth monitoring condition is satisfied (S20). When it is determined that the fifth monitoring condition is satisfied (S20/Y), the CP controller 100 outputs a warning (S24).

The fifth monitoring condition means that a temperature of the first stage cryopanel has not returned to a temperature lower than or equal to a reference temperature within a reference return period of time since an operating cycle of the refrigerator motor 26 has reached the upper limit. It is desirable that the reference return period of time is shorter than the period of time necessary for the baking processing of the vacuum apparatus, and is set to, for example, a period of time within several hours. The reference temperature is set to be higher than a target temperature; however, it is desirable to be lower than an alert temperature at which a warning is outputted in the vacuum apparatus.

The CP controller 100 starts timekeeping when an operating cycle has newly reached the upper limit cycle in the monitoring processing of this time. The CP controller 100 determines whether a temperature of the first stage cryopanel is cooled to a temperature lower than the reference temperature in, the subsequent monitoring processing, and when it is not cooled, the CP controller then determines whether the elapsed time exceeds the reference return period of time. When exceeding the reference return period of time, the CP controller 100 determines that the fifth monitoring condition is satisfied. When a temperature of the first stage cryopanel has been cooled to a temperature lower than or equal to the reference temperature, the count of the elapsed time is reset and it is determined that the fifth monitoring condition is not satisfied. If a temperature of the first stage cryopanel is lower than the reference temperature when an operating cycle has reached the upper limit, the CP controller may determine that the fifth monitoring condition is not satisfied.

When it is determined that the fifth monitoring condition is not satisfied (S20/N), the CP controller determines whether a sixth monitoring condition is satisfied (S22). When it is determined that the sixth monitoring condition is satisfied (S22/Y), the CP controller outputs a warning (S24). When it is determined that the sixth monitoring condition is not satisfied (S22/N), the CP controller 100 ends the monitoring processing without outputting a warning, and waits until the next processing.

The sixth monitoring condition means that it is assumed that performance degradation has occurred in the drive unit of the refrigerator 12. Specifically, when a state in which each of an operating cycle of the refrigerator motor 26, a temperature of the first stage cryopanel, and that of the second stage cryopanel, exceeds a threshold value, has been continued for a preset period of time or longer, the CP controller 100 determines that the performance degradation has occurred in the drive unit of the refrigerator 12. When the first stage cryopanel and the second stage cryopanel are not fully cooled although an operating cycle of the refrigerator motor 26 has been increased, it can be estimated that performance degradation has occurred in the drive unit of the refrigerator 12.

For example, the threshold value of an operating cycle is set to be equal to the monitoring start cycle of the fourth monitoring condition. The threshold value of a temperature of the first stage cryopanel is set to be equal to the reference temperature of the fifth monitoring condition. The threshold value of a temperature of the second stage cryopanel is set to be equal to the cautionary temperature of the second monitoring condition. By sharing the threshold values as stated above, it becomes possible to utilize a determination of another monitoring item. In addition, the preset period of time is set to be equal to that of the second monitoring condition.

When a temperature of the second stage cryopanel has returned to a temperature lower than or equal to the threshold value while a state in which an operating cycle of the refrigerator motor 26 and a temperature of the first stage cryopanel respectively exceed the threshold values, is being continued, it is emperically known that the possibility of the baking processing being performed in the vacuum apparatus is high. Accordingly, when a state in which an operating cycle of the refrigerator motor 26 and a temperature of the first stage cryopanel respectively exceed the threshold values, has been continued for the preset period of time or longer, and when a temperature of the second stage cryopanel has returned within the preset period of time, the CP controller 100 may determine that the baking processing is being performed in the vacuum apparatus.

Figure 4:
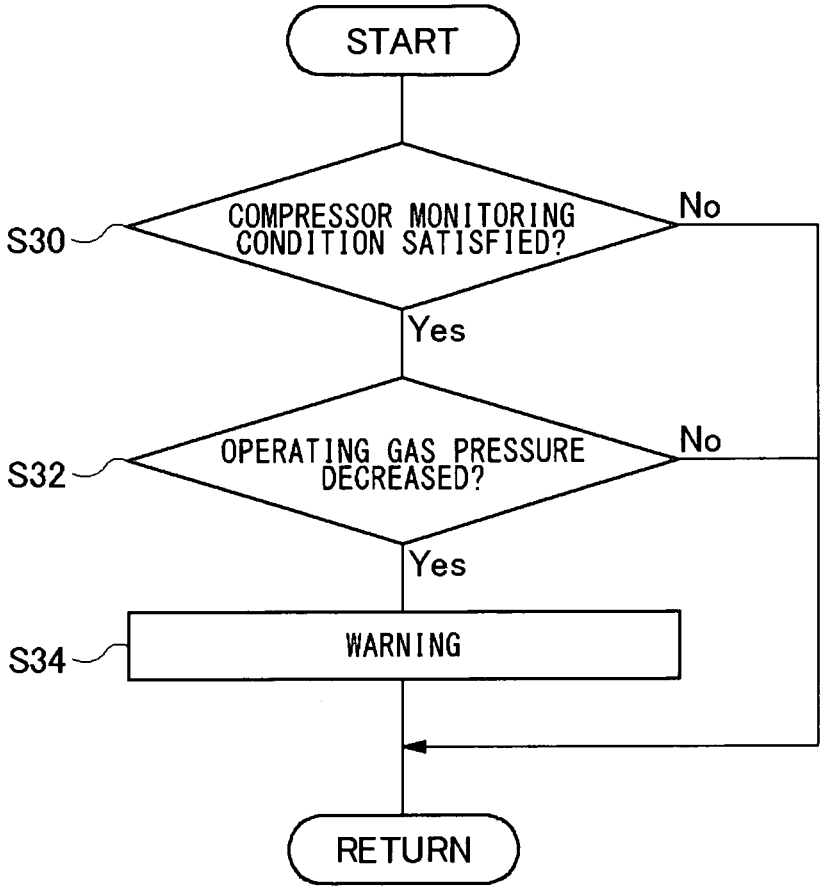
FIG. 4 is a flowchart for illustrating monitoring processing according to another embodiment.

FIG. 4 is a flowchart for illustrating monitoring processing according to another embodiment. The processing illustrated in FIG. 4 is repeatedly performed by the CP controller 100 at a predetermined cycle during an operation of the cryopump 10. The CP controller 100 monitors operating gas pressure of the compressor 40 while the monitoring start condition is being satisfied. The CP controller 100 outputs a warning when a state in which the operating gas pressure is decreased, has been continued. The CP controller 100 may perform both the processing illustrated in FIGS. 3 and 4, or perform only the processing illustrated in FIG. 4. In the following descriptions, it is assumed that a plurality of cryopumps are connected with the compressor 40 to supply the operating gas. However, the same processing can be performed even when the single cryopump 10 is connected with the compressor 40.

The CP controller 100 at first determines whether compressor monitoring condition is satisfied (S30). Herein, the compressor monitoring condition means a state in which at least one of the cryopumps 10 is in an operation mode of T1 temperature control and all of the cryopumps 10 are not being regenerated. When it is determined that the compressor monitoring condition is not satisfied (S30/N), the CP controller 100 ends the processing without monitoring an operation state of the compressor. Accordingly, when all of the cryopumps 10 are in stopped states, or when at least one of the cryopumps 10 is being regenerated, the CP controller 100 does not perform the monitoring processing of the compressor 40.

When the compressor monitoring condition is satisfied (S30/Y), the CP controller 100 determines whether the operating gas pressure of the compressor 40 is decreased (S32). The CP controller 100 determines whether the measured pressure of the first pressure sensor 43, which measures the operating gas pressure on the discharge side, i.e., on the higher pressure side of the compressor 40, has been below a reference pressure continuously for a preset period of time or longer. The reference pressure may be, for example, the lower limit value of the recommended pressure range, specified as a specification of the compressor. The preset period of time is set, for example, to the same extent as that of the aforementioned sixth monitoring condition. It is noted that the measured pressure of the second pressure sensor 45, which measures the operating gas pressure on the inhale side, i.e., on the lower pressure side of the compressor 40, may be adopted instead of the first pressure sensor 43.

When it is determined that the measured pressure has been below the reference pressure continuously for the preset period of time or longer (S32/Y), the CP controller 100 outputs a warning (S34). On the other hand, the measured pressure has returned to pressure greater than or equal to the reference pressure within the preset period of time (S32/N), the CP controller 100 ends the monitoring processing without outputting a warning, and waits until the next processing. Specifically, the CP controller 100 starts timekeeping when the operating gas measured pressure newly becomes below the reference pressure in the monitoring processing of this time. The CP controller 100 determines whether the measured pressure remains below the reference pressure in the subsequent monitoring processing, and when remaining below the reference pressure, then determines whether the elapsed time has exceeded the preset period of time. When exceeding the preset period of time, the CP controller 100 outputs a warning. When the measured pressure has returned to pressure greater than or equal to the reference pressure within the preset period of time, the count of the elapsed time is reset. Thus, a decrease in the pressure, occurring due to a leak of the operating gas, etc., can be monitored.

Monitoring of the compressor may be performed while at least one of the cryopumps 10 is being regenerated. In this case, a compressor monitoring condition is that at least one of the cryopumps 10 is in an operating mode of the T1 temperature control. However, when a cryopump being in a regenerative operation is present, the operating gas pressure is increased/decreased in comparison with a normal pumping operation (e.g., T1 temperature control). Accordingly, it is desirable to appropriately adjust the reference pressure. For example, because there is a tendency that the operating gas pressure during a heating-up step in a regenerative operation is increased in comparison with the pumping operation, it is desirable to increase the reference pressure. In contrast, there is a tendency that the operating gas pressure during a cooling step in the regenerative operation is decreased in comparison with a pumping operation, it is desirable to decrease the reference pressure.

What is claimed is:

1. A cryopump for pumping gas from a vacuum chamber in a vacuum apparatus performing vacuum processing, the cryopump comprising:

a refrigerator comprising a first stage configured to be cooled to a first temperature and a second stage configured to be cooled to a second temperature lower than the first temperature;

a first cryopanel cooled by the first stage of the refrigerator;

a second cryopanel cooled by the second stage of the refrigerator; and a controller configured to control a heat cycle frequency of the refrigerator to cool the first cryopanel and the second cryopanel to the first temperature and the second temperature, respectively, and, thereafter, maintaining the first temperature substantially at a target temperature during a normal pumping operation mode of the refrigerator, and monitoring the heat cycle frequency of the refrigerator during the normal pumping operation mode, the target temperature being a selected, fixed temperature setting of the first cryopanel of the cryopump at which the first cryopanel is cryogenically cooled by the refrigerator and, in the normal pumping operation mode, the controller controls the refrigerator to cool the first cryopanel such that the temperature of the first cryopanel is maintained at the target temperature;

wherein, if the controller determines that the heat cycle frequency of the refrigerator exceeds a first determination heat cycle frequency reference parameter being a preset, threshold heat cycle frequency value of the heat cycle frequency used by the controller to control the refrigerator, then the controller determines a first amount of elapsed time from when the heat cycle frequency of the refrigerator exceeds the first determination heat cycle frequency reference parameter and, thereafter, the controller determines whether the first amount of elapsed time exceeds a first determination period of time, the first determination period of time being a preset period of time used by the controller to control the refrigerator, wherein, if the controller determines that the heat cycle frequency of the refrigerator exceeds a second determination heat cycle frequency reference parameter that is greater than the first determination heat cycle frequency reference parameter, then the controller monitors the first temperature of the first cryopanel and determines a second amount of elapsed time from when the heat cycle frequency of the refrigerator exceeds the second determination heat cycle frequency reference parameter and, thereafter, the controller determines whether the second amount of elapsed time exceeds a second determination period of time, which is shorter than the first determination period of time, wherein the first determination heat cycle frequency reference parameter is greater than a maximum heat cycle frequency parameter being a maximum value during the normal pumping operation mode occurring in the vacuum processing.

2. The cryopump according to claim 1, wherein the first determination period of time is set to be longer than a baking period of time necessary for baking processing, and the second determination period of time to be shorter than the baking period of time, the baking processing providing heat-treatment to the vacuum chamber to discharge gas molecules absorbed on the chamber walls from the chamber and the baking period of time being a length of time from start to finish during which the baking processing occurs.

3. The cryopump according to claim 1, wherein, if the controller determines that the heat cycle frequency of the refrigerator exceeds the first determination heat cycle frequency reference parameter and that the first amount of elapsed time exceeds the first determination period of time, then the controller determines a performance degradation of the cryopump.

4. The cryopump according to claim 1, wherein, if a state in which each of heat cycle frequency of the refrigerator, the first temperature of the first cryopanel, and a second temperature of the second cryopanel exceeds each corresponding threshold value, continues for a preset period of time or longer during the normal pumping operation mode, then the controller determines a malfunction of the refrigerator.

5. The cryopump according to claim 4, wherein, if a state in which both of the heat cycle frequency of the refrigerator and the first temperature of the first cryopanel exceed their threshold values, continues for the preset period of time or longer, and if the second temperature of the second stage cryopanel falls below the threshold value within the preset period of time, then the controller determines that baking processing is being performed in the vacuum apparatus.

6. The cryopump according to claim 1, wherein, if the controller determines that the heat cycle frequency of the refrigerator exceeds the second determination heat cycle frequency reference parameter, then the controller determines whether the first temperature of the first cryopanel is lower than a reference temperature, which is higher than the target temperature, wherein, if the controller determines that the first temperature of the first cryopanel is lower than the reference temperature, then the controller resets a count of the second elapsed time.

* * * * *